US006835303B2

(12) United States Patent
Mahajan

(10) Patent No.: US 6,835,303 B2
(45) Date of Patent: Dec. 28, 2004

(54) METHOD FOR REDUCING THE SULFUR CONTENT OF A SULFUR-CONTAINING HYDROCARBON STREAM

(75) Inventor: Devinder Mahajan, South Setauket, NY (US)

(73) Assignee: Brookhaven Science Associates, LLC, Upton, NY (US)

( * ) Notice: Subject to any disclaimer, the term of this patent is extended or adjusted under 35 U.S.C. 154(b) by 231 days.

(21) Appl. No.: 09/957,256

(22) Filed: Sep. 21, 2001

(65) Prior Publication Data

US 2003/0102255 A1 Jun. 5, 2003

(51) Int. Cl.[7] ..... C10G 45/00; C10G 45/04; C10G 45/60

(52) U.S. Cl. ..... 208/208 R; 208/209; 208/213; 208/214; 208/216 R; 208/217; 208/243; 208/244; 204/157.62

(58) Field of Search ..... 208/208 R, 209, 208/213, 214, 216 R, 217, 243, 244; 204/157.62

(56) References Cited

U.S. PATENT DOCUMENTS

| | | | | |
|---|---|---|---|---|
| 1,944,170 A | * | 1/1934 | Darlington | 208/47 |
| 3,497,005 A | | 2/1970 | Pelopsky et al. | 166/247 |
| 3,616,375 A | | 10/1971 | Inoue | 204/157.62 |
| 3,984,529 A | | 10/1976 | Tung | 423/575 |
| 4,028,246 A | | 6/1977 | Lund et al. | 210/151 |
| 4,118,282 A | | 10/1978 | Wallace | 201/2.5 |
| 4,391,608 A | | 7/1983 | Dondelewski | 44/624 |
| 4,537,599 A | | 8/1985 | Greenwald, Sr. | 44/624 |
| 4,640,692 A | | 2/1987 | Audeh | 44/624 |
| 5,110,443 A | | 5/1992 | Gregoli et al. | 208/46 |
| 5,547,563 A | | 8/1996 | Stowe | 208/106 |
| 5,547,585 A | | 8/1996 | Shepherd et al. | 210/673 |
| 5,674,379 A | | 10/1997 | Debras et al. | 208/244 |
| 5,753,102 A | | 5/1998 | Funakoshi et al. | 208/208 R |
| 5,770,046 A | | 6/1998 | Sudhakar | 208/216 R |
| 5,824,214 A | | 10/1998 | Paul et al. | 208/107 |
| 6,042,798 A | | 3/2000 | Masuda et al. | 423/244.01 |

* cited by examiner

*Primary Examiner*—Walter D. Griffin
*Assistant Examiner*—Tam M. Nguyen
(74) *Attorney, Agent, or Firm*—Margaret C. Bogosian

(57) ABSTRACT

The sulfur content of a liquid hydrocarbon stream is reduced under mild conditions by contracting a sulfur-containing liquid hydrocarbon stream with transition metal particles containing the transition metal in a zero oxidation state under conditions sufficient to provide a hydrocarbon product having a reduced sulfur content and metal sulfide particles. The transition metal particles can be produced in situ by adding a transition metal precursor, e.g., a transition metal carbonyl compound, to the sulfur-containing liquid feed stream and sonicating the feed steam/transition metal precursor combination under conditions sufficient to produce the transition metal particles.

10 Claims, 3 Drawing Sheets

METHOD FOR REDUCING THE SULFUR CONTENT OF A SULFUR-CONTAINING HYDROCARBON STREAM

This invention was made with Government support under contract number DE-AC02-98CH10886, awarded by the U.S. Department of Energy. The Government has certain rights in the invention.

BACKGROUND OF THE INVENTION

This invention relates to reducing the sulfur content of a sulfur-containing hydrocarbon stream. In particular, the invention relates to a method which removes sulfur from the hydrocarbon stream under mild conditions.

Heavy petroleum fractions, such as vacuum gas oil or resides may be catalytically cracked to lighter and more valuable products. The product of catalytic cracking is conventionally recovered and the products fractionated into various fractions such as light gases; naphtha, including light and heavy gasoline; distillate fractions, such as heating oil and diesel fuel; lube fractions; and heavier fractions.

Generally, sulfur occurs in petroleum and petroleum products as hydrogen sulfide, organic sulfides, organic disulfides, mercaptans, also known as thiols, and aromatic ring compounds such as thiophene, benzothiophene (BT), dibenzothiophene (DBT) and their alkylated homologues. The sulfur in aromatic sulfur-containing ring compounds will be herein referred to as "thiophenic sulfur".

Where a petroleum fraction is being catalytically cracked and contains sulfur, the products of catalytic cracking usually contain sulfur impurities which normally require removal, usually by hydrotreating, in order to comply with the relevant product specifications. Such hydrotreating can be done either before or after catalytic cracking.

Conventionally, feeds with substantial amounts of sulfur, for example, those with more than 500 ppm sulfur, are hydrotreated with conventional hydrotreating catalysts under conventional conditions, thereby changing the form of most of the sulfur in the feed to hydrogen sulfide. The hydrogen sulfide is then removed by amine absorption, stripping or related techniques. Unfortunately, these techniques often leave some traces of sulfur in the feed, including thiophenic sulfur, which are the most difficult types to convert.

The ease of sulfur removal from petroleum and its products is dependent upon the type of sulfur-containing compound. Mercaptans are relatively easy to remove, whereas aromatic compounds such as thiophenes are more difficult to remove. Of the thiophenic sulfur compounds, the alkyl substituted dibenzothiophenes are particularly resistant to hydrodesulfurization.

The sulfur impurities in petroleum fractions which boil in either the distillate boiling range, such as diesel fuel, or the gasoline range are usually removed by hydrotreating, in order to comply with product specifications or to ensure compliance with environmental regulations both of which are expected to become more stringent in the future, possibly permitting no more than about 30–50 ppmw sulfur in both diesel fuel and motor fuel gasolines. Low sulfur levels can contribute to reduced emissions of CO, NOx and hydrocarbons.

Hydrotreating any of the sulfur containing fractions which boil in the distillate boiling range, such as diesel fuel, causes a reduction in the aromatic content and, therefore, an increase in the cetane number of diesel fuel. While hydrotreating reacts hydrogen with the sulfur containing molecules in order to convert the sulfur and remove it as hydrogen sulfide, as with any operation which reacts hydrogen with a petroleum fraction, the hydrogen does not only react with the sulfur as desired. For example, other contaminant molecules containing nitrogen undergo hydrodenitrogenation in a manner analogous to hydrodesulfurization. Unfortunately, some of the hydrogen may also cause hydrocracking, as well as aromatic saturation, especially during more severe operating conditions of increased temperature and/or pressure. Typically, as the degree of desulfurization increases, the cetane number of the diesel fuel increases; however this increase is generally slight, usually from 1–3 numbers.

Hydrotreating can be effective in reducing the level of sulfur to moderate levels, e.g. 500 ppm, without a severe degradation of the desired product. However, to achieve the levels of desulfurization that will be required by the new regulations, almost all sulfur compounds will need to be removed, even those that are difficult to remove such as DBTs. These refractory sulfur compounds can be removed by distillation, but with substantial economic penalty, i.e., downgrading a portion of automotive diesel oil to heavy fuel oil.

Cracked naphtha, as it comes from a catalytic or thermal conversion process and without any further treatments, such as purifying operations, has a relatively high octane number, due, in part, to the presence of olefinic components. As such, cracked naphtha is an excellent contributor to the gasoline pool, providing a large quantity of product at a high blending octane number. In some cases, this fraction may contribute as much as up to half the gasoline in the refinery pool. In special situations, where a refinery has no catalytic reformer, the cracked naphtha may represent as much as 80% of the refinery's gasoline.

Hydrotreating of any of the sulfur-containing fractions of cracked gasoline causes a reduction in the olefin content. Current sulfur specifications can often be met without excessive octane loss by hydrotreating only the heaviest, most sulfur-rich and olefin-poor portion of the FCC gasoline. As the future pool sulfur specification is reduced, increasing amounts of lighter boiling, olefin-rich, gasoline must be processed and the octane penalty can increase dramatically due to olefin saturation in these lighter gasoline fractions. The decrease in octane which takes place as a consequence of sulfur removal by hydrotreating creates a tension between the need to produce gasoline fuels with sufficiently high octane number and, because of current ecological considerations, the need to produce cleaner burning, less polluting fuels, especially low sulfur fuels.

Methods have been proposed for offsetting pool octane reductions which could occur if severely hydrotreated, wide-cut FCC gasoline were introduced into the pool. Catalytic reforming increases the octane of virgin and hydrocracked naphthas by converting at least a portion of the paraffins and cycloparaffins to aromatics in these very low olefin content feeds. Reforming severity might be boosted to further increase the octane of the reformate going into the gasoline pool, thereby offsetting the negative impact on the pool from blending hydrotreated wide cut FCC gasoline. This approach, however, has two limitations. First, reformate yield declines as severity is increased which could negatively impact the total gasoline pool volume. Second, as already noted, aromatization reactions account, to a large degree, for the octane enhancement in reforming. Aromatics, however, particularly benzene, have been the subject of severe limitations as a gasoline component because of possible adverse effects on the ecology. It has therefore become desirable, as far as is feasible, to create a gasoline pool in which the higher octanes are contributed by non-aromatic components.

As noted above, the more restrictive gasoline pool sulfur specifications that are anticipated often will not be met by processing only the heaviest, sulfur-rich olefin-poor portion of the FCC gasoline. For this reason, the lighter components, including light and possibly full range FCC naphthas, will have to be treated to achieve acceptable sulfur levels. However, the octane loss, associated with hydroprocessing, or yield loss, associated with processes aimed at recovering that lost octane, can increase dramatically as the boiling point range of the gasoline feed being treated widens.

Consequently, it is desirable to develop methods for preserving yield and octane while removing sulfur from the relatively olefin-rich light and mid-range portions of the FCC gasoline pool.

Thus, there remains a need for a method of removing sulfur from hydrocarbon feeds which contain sulfur compounds, including thiophenic sulfur compounds, under moderate process conditions and maintaining the characteristics of the feed stream.

SUMMARY OF THE INVENTION

The present invention is directed to a method for reducing the sulfur content of a sulfur-containing hydrocarbon stream under mild conditions. A process is provided in which sulfur is removed from a sulfur-containing hydrocarbon liquid feed stream by:

contacting the hydrocarbon stream with transition metal particles, containing the transition metal in a zero oxidation state and having an average diameter of less than about 200 nm, under reaction conditions sufficient to provide a product having a reduced sulfur content and metal sulfide particles; and separating the metal sulfide particles from the product.

In a preferred embodiment, the transition metal particles are provided by adding a source of transition metal precursors to the liquid feed stream and sonicating the liquid feed stream/metal precursor combination under conditions sufficient to produce the transition metal particles.

Preferably, the source of transition metal precursors includes a transition metal carbonyl precursor.

The transition metal carbonyl precursor is preferably of the formula:

$$M_n(CO)_x$$

wherein M is a transition metal selected from an element from Groups 6 and 8–12 of the period table, n is an integer from 1 to 6 and x is an integer from 4 to 16.

Preferably, the transition metal is selected from Fe or Mo, with the corresponding transition metal precursor being Fe $(CO)_5$ and Mo $(CO)_6$, respectively.

The source of transition metal precursors is preferably added to the liquid feed stream in an amount sufficient to provide at least a 1:1 molar ratio of metal: sulfur.

The sonication conditions can include contacting the feed stream with sonic energy having a frequency in the range of about 1 Hz to about 20 kHz, at a temperature in the range of about 10 to about 150° C. and a sonication residence time in the range of about 1 second to about 2 hours.

The separating step can be accomplished through at least one of settling out, decanting, filtration or centrifugal separation.

In a preferred embodiment, the present invention is directed to a method for reducing the sulfur content of a sulfur-containing hydrocarbon liquid feed stream under mild conditions, in which the method includes:

adding a transition metal carbonyl precursor to the liquid feed stream;

sonicating the liquid feed stream containing the transition metal carbonyl precursor at a temperature in the range of about 10° C. to about 150° C. for a time sufficient to produce solid metal sulfide particles and a liquid product having a reduced sulfur content; and separating the solid metal sulfide particles from the product.

The method can also include adding a solvent to the liquid feedstream prior to the sonicating step.

The present invention provides a method for reducing the sulfur content, including thiophenic sulfur compounds, of a sulfur-containing hydrocarbon stream under mild conditions. The resulting product stream will have a reduced sulfur content, while preserving the yield, chemical composition and motor fuel performance characteristics, e.g., octane, of the feed stream.

Additional objects, advantages and novel features of the invention will be set forth in part in the description and examples which follow, and in part will become apparent to those skilled in the art upon examination of the following, or may be learned by practice of the invention. The objects and advantages of the invention may be realized and attained by means of the instrumentalities and combinations particularly pointed out in the appended claims.

DETAILED DESCRIPTION OF INVENTION

Figure 1:
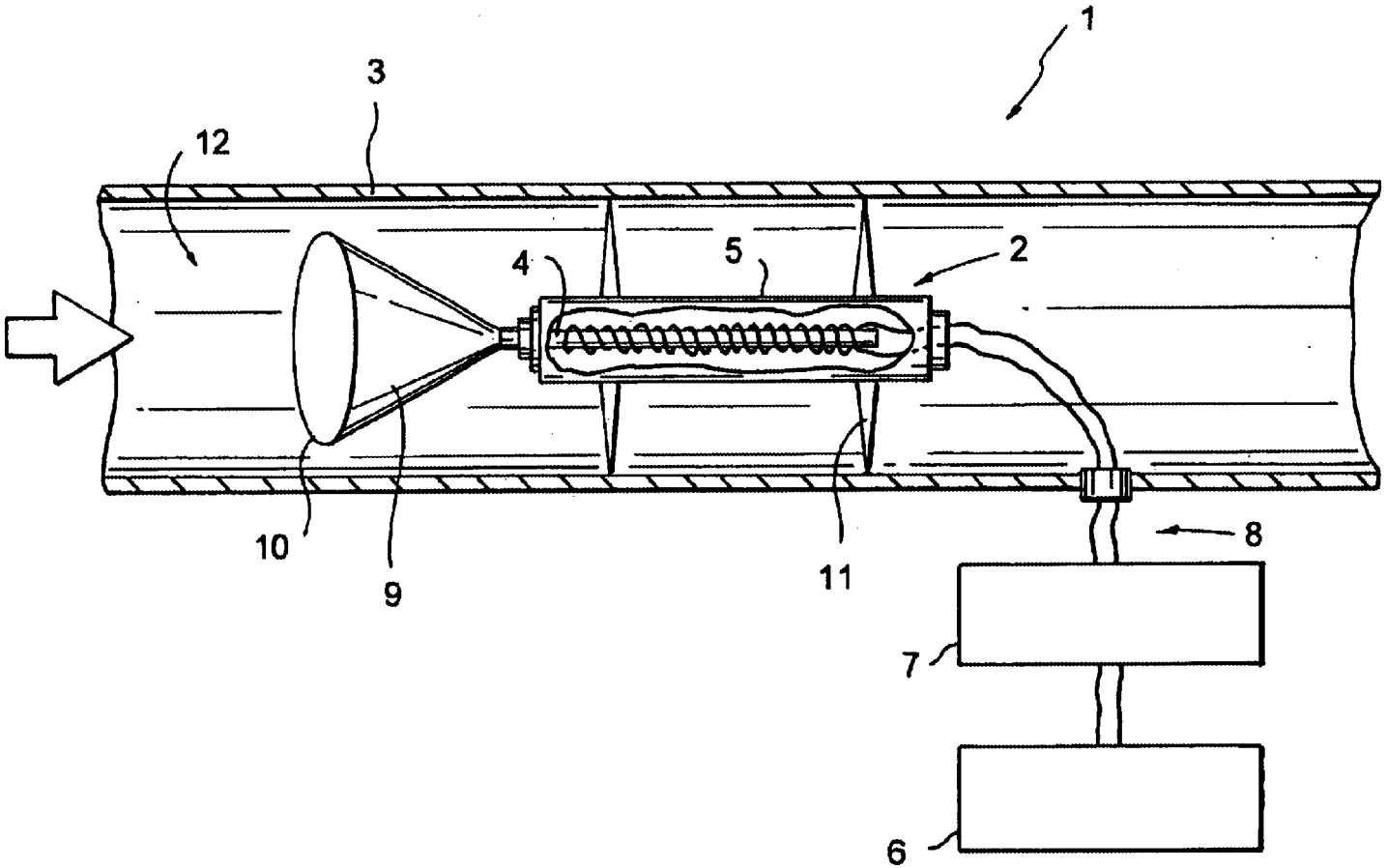
FIG. 1 is a schematic of a continuous tubular sonic reactor.

The present invention is directed to a method for reducing the sulfur content of a sulfur-containing hydrocarbon stream. Unlike conventional desulfurization methods which rely on extreme process conditions or unique combinations of feedstock, catalyst volume, and pressure; the process of the invention relies upon the ability to process the petroleum under mild conditions and effectively remove the sulfur from the sulfur compounds, including polyaromatic sulfur compounds which impede conventional desulfurization processes.

The hydrocarbon feedstock can include any sulfur-containing liquid hydrocarbon stream, however, it is more likely to utilize the current process in connection with feedstocks for diesel fuel or gasoline, since the trend for environmental regulations is to lower the maximum sulfur content of these fuels.

The present invention is particularly useful for feedstocks which can be described as high boiling point feeds of petroleum origin, since these feeds generally contain higher levels of the aromatic (or thiophenic) sulfur compounds. In general, such feeds will have a boiling point range of about 350° F. to about 750° F.(about 175° C. to about 400° C.), preferably about 400° F. to about 700° F.(about 205° C. to about 370° C.). Generally, these feedstocks are: (a) non-thermocracked streams, such as gas oils distilled from various petroleum sources, (b) catalytically cracked stocks, including light cycle oil (LCO) and heavy cycle oil (HCO), clarified slurry oil (CSO), (c) thermally cracked stocks such as coker gas oils, visbreaker oils or related materials, and (d) any of the above which have undergone partial hydrotreatment.

Cycle oils from catalytic cracking processes typically have a boiling range of about 400° F. to 750° F. (about 205° C. to 400° C.), although light cycle oils may have a lower end point, e.g. 600° F. or 650° F. (about 315° C. or 345° C.). Because of the high content of aromatics and poisons such as nitrogen and sulfur found in such cycle oils, they require more severe hydrotreating conditions, which can cause a loss of distillate product.

Lighter feeds to the process can include a sulfur-containing petroleum fraction which boils in the gasoline boiling range. Feeds of this type include light naphthas typically having a boiling range of about $C_6$ to 330° F., full range naphthas typically having a boiling range of about $C_5$ to 420° F., heavier naphtha fractions boiling in the range of about 260° F. to 420° F., or heavy gasoline fractions boiling at, or at least within, the range of about 330° to 500° F., preferably about 330° to 420° F.

The process may be operated with the entire cracked gasoline fraction or, alternatively, with part of it. Because the sulfur tends to be concentrated in the higher boiling fractions, it is preferable, particularly when unit capacity is limited, to separate the higher boiling fractions and process them through the steps of the present process without processing the lower boiling cut. The cut point between the treated and untreated fractions may vary according to the sulfur compounds present but usually, a cut point in the range of from about 100° F. (38° C.) to 300° F. (150° C.), more usually in the range of about 150° F. (65° C.) to 300° F. (150° C.) will be suitable. The exact cut point selected will depend on the sulfur specification for the gasoline product as well as on the type of sulfur compounds present. Sulfur which is present in components boiling below about 150° F. (65° C.) is mostly in the form of mercaptans, which may be removed by extractive type processes.

Hydrotreating is appropriate to remove sulfur in the form of mercaptans, and to some extent for the removal of thiophene and other cyclic sulfur compounds present in higher boiling components, e.g. component fractions boiling above about 180° F. (82° C.). However, hydrotreating is generally only effective to reduce the sulfur content to about 500 ppmw when operated under moderate conditions, as discussed more fully below. Treatment of the lower boiling fraction in an extractive type process coupled with hydrotreating of the higher boiling component may therefore represent a preferred economic process option. Higher cut points will be preferred in order to minimize the amount of feed which is passed to the hydrotreater and the final selection of cut point together with other process options such as the extractive type desulfurization will therefore be made in accordance with the product specifications, feed constraints and other factors.

The sulfur content of these catalytically or thermally cracked fractions will depend on the sulfur content of the feed to the catalytic or thermal conversion unit as well as on the boiling range of the selected fraction used as the feed in the process. Lighter fractions, for example, will tend to have lower sulfur contents than the higher boiling fractions. As a practical matter, the sulfur content will exceed 50 ppmw, usually in excess of 100 ppmw and in most cases in excess of about 500 ppmw. For the fractions which have 95 percent points over about 380° F. (193° C.), the sulfur content may exceed about 1,000 ppmw and may be as high as 4,000 or 5,000 ppmw or even higher. The nitrogen content is not as characteristic of the feed as the sulfur content and is preferably not greater than about 20 ppmw although higher nitrogen levels typically up to about 50 ppmw may be found in certain higher boiling feeds with 95 percent points in excess of about 380° F. (193° C.). The nitrogen level will, however, usually not be greater than 250 or 300 ppmw. As a result of the cracking which has preceded the steps of the present process, the feed to the hydrodesulfurization step will be olefinic, with an olefin content typically in the range of about 10 to 30 weight percent.

A preferred economic process option may include hydrotreating the sulfur-containing liquid hydrocarbon feed stream in a first step under moderate process conditions. Thus in one embodiment, the feed stream is first hydrotreated under conventional methods to convert nitrogen and sulfur containing compounds to gaseous ammonia and hydrogen sulfide. At this stage, hydrocracking is minimized, but partial hydrogenation of polycyclic aromatics proceeds, together with a limited degree of conversion to lower boiling (343° C., 650° F.) products. The catalyst used in this stage may be a conventional hydrotreating catalyst. Catalysts of this type are relatively immune to poisoning by the nitrogenous and sulfurous impurities in the feedstock and generally comprise a non-noble metal component supported on an amorphous, porous carrier such as silica, alumina, titania, silica-alumina or silica-magnesia. Because extensive cracking is not desired in this stage of the process, the acidic functionality of the carrier should be relatively low.

The metal component of the hydrotreating catalyst may be a single metal from Groups VIA and VIIIA of the Periodic Table such as nickel, cobalt, chromium, vanadium, molybdenum, tungsten, or a combination of metals such as nickel-molybdenum, cobalt-nickel-molybdenum, cobalt-molybdenum, nickel-tungsten or nickel-tungsten-titanium. Generally, the metal component will be selected for good hydrogen transfer activity. The catalyst as a whole will have good hydrogen transfer and minimal cracking characteristics. The catalyst should be pre-sulfided in the normal way in order to convert the metal component (usually impregnated into the carrier and converted to oxide) to the corresponding sulfide, and oxysulfide.

After desulfurization in the hydrotreating step and removal of $H_2S$ and $NH_3$, the resulting effluent contains approximately 500 ppm sulfur or less. Essentially all of the remaining sulfur containing compounds remaining in the effluent are sterically hindered dibenzothiophene (DBT) and its alkyl homologs, which are difficult to desulfurize by hydrotreating. Table 1 demonstrates the relative reactivity of the various sulfur containing compounds that may be contained in the hydrocarbon effluent or feed.

TABLE 1

Relative Rate of Hydrodesulfurization

| Reactant | Structure[a] | First Order Relative Rate Constant[b] |
|---|---|---|
| Thiokol | R—SH | 5000 |
| Disulfides | RSSR | 5000 |
| Sulfides | RSR | 5000 |
| Thiophene | 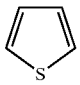 | 5000 |
| Benzothiophene | 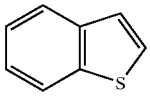 | 2900 |
| Dibenzothiophene (DBT) | 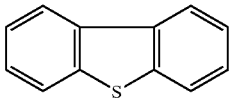 | 220 |
| 4,6-Dimethyl dibenzothiophene | 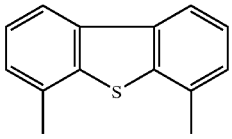 | 22 |
| 4,6-Dimethyl tribenzothiophene | 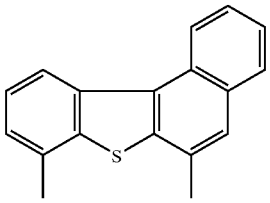 | 1100 |
| Benzonaphthothiophene | 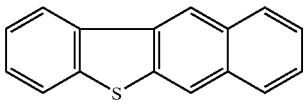 | 580 |

[a]R refers to any hydrocarbon group attached to the sulfur atom.
[b]B.C. Gates, J.R. Katzer, and G.C.A. Schuit, "Chemistry of Catalytic Processes," McGraw-Hill (1979) and H. Topsoe, B.S. Clausen, and F.E. Massoth, "Hydrotreating Catalysis: Science and Technology," Springer (1996).

As shown in Table 1, the rate of reactivity of hydrodesulfurization is low for DBT compounds, particularly 4,6-dimethyl dibenzothiophene.

The boiling range of substituted and non-substituted DBT is 530–750° F. As the percent hydro-desulfurization increases, the relative percentage of DBTs increase.

To achieve further desulfurization of a hydrocarbon source containing the sterically hindered species without using severe process conditions, the focus must be shifted from the conventional hydrotreating process. While not being bound by theory, the process of the invention increases the rate and amount of desulfurization by directly reacting the sulfur contained in the polyaromatic sulfur compounds, including DBTs, remaining in the effluent after the hydrotreating step.

Since the sulfur containing compounds remaining in the effluent after the hydrotreating mainly consist of DBTs, and DBTs have the slowest desulfurization rate, DBTs are the primary concern. The typical desulfurization reaction of 4,6-dimethyl DBT is:

(I)

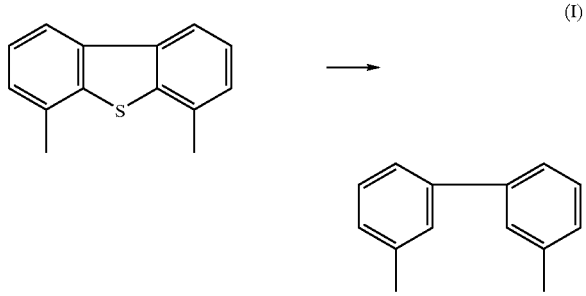

At a pressure less than 800 psig with a conventional base metal catalyst, the reaction shown in formula I is extremely slow. At higher pressures, e.g. 1200–2000 psig, one of the aromatic rings can be hydrogenated in the presence of a base metal catalyst and the desulfurization reaction rate for the partially hydrogenated compound will increase. However, it is undersirable to operate at such severe pressure conditions because of the capital costs associated with the equipment. The process of the invention allows for desired desulfurization reactions to occur under mild conditions.

According to the process of the invention, sulfur is removed from a sulfur-containing hydrocarbon liquid feed stream by:

contacting the hydrocarbon stream with transition metal particles, containing transition metal in a zero oxidation state and having an average diameter of less than about 200 nm, under reaction conditions sufficient to provide a product having a reduced sulfur content and metal sulfide particles; and separating the metal sulfide particles from the product.

It is preferred that the hydrotreatment process be performed in a first reaction vessel and the effluent from the hydrotreatment step be contacted with the transition metal particles according to the invention in a second reaction vessel. However, with an appropriate hydrocarbon feed and under appropriate process conditions, it is possible to have a reactor scheme where the hydrotreating catalyst and the metal particles according to the invention are contained within the same reactor.

In the hydrotreating stage, the nitrogen and sulfur impurities are converted to ammonia and hydrogen sulfide. At the same time, the polycyclic aromatics are partially hydrogenated to form naphthenes and hydroaromatics. It is believed that the sulfur in the hydrogen sulfide can react with the transition metal particles in accordance with the invention.

Therefore, in a preferred embodiment, the ammonia and hydrogen sulfide are removed from the effluent by a conventional interstage separation process, such as interstage stripping or distillation, before the effluent proceeds to the process of the present invention. The interstage separation removes $H_2S$, $NH_3$ and light gases, e.g., $C_1$–$C_4$ hydrocarbons, from the effluent before the effluent proceeds to the transition metal particles of the present invention. Also, it may be preferable to employ separate reaction vessels because of the different process conditions.

In a separate preferred method, the $H_2S$ and $NH_3$ are separated along with a light fraction of the effluent. This separation can be performed during interstage distillation. This separation allows the high boiling point product of approximately 530–750° F. to be separately contacted with the metal particles in accordance with the invention. The light fraction, i.e. effluent boiling from approximately 330–550° F., which is virtually free of sulfur, can then be recombined with the processed higher boiling range product yielding a mixture containing 50 ppm sulfur or less. Because the lighter fraction of effluent is removed, the addition of a distillation column enables a much smaller second reactor to be used with more specific operating parameters when the heavier effluent is contacted with the metal particles. In the case with no interstage stripping, hydrogen quenching may be carried out in order to control the effluent temperature and to control the temperature in the second stage.

In a preferred embodiment, the transition metal particles are provided by adding a source of transition metal precursors to the liquid feed stream and sonicating the liquid feed stream/metal precursor combination under conditions sufficient to produce the transition metal particles.

Optionally, a solvent can be added to the liquid feed stream prior to sonication to reduce the viscosity of the hydrocarbon feed stream or to assist in dissolving the metal precursors. Any liquid hydrocarbon solvent or a mixture thereof in any volume, weight or mole ratio that allows the sonication reaction to proceed can be used. Preferred solvents include, for example liquid hydrocarbons having a carbon chain length between about $C_4$–$C_{30}$.

Preferably, the source of transition metal precursors includes a transition metal carbonyl precursor. The transition metal carbonyl precursor is preferably of the formula:

$$M_n(CO)_x$$

wherein M is a transition metal selected from the metal values of Groups 6 and 8–12 (IUPAC classification, previously Groups Vib, VIII, Ib and IIb) of the periodic table, n is an integer from 1 to 6 and x is an integer from 4 to 16, in which n and x correspond to a stable metal carbonyl compound at room temperature.

Preferably, the transition metal is selected from Fe or Mo, with the corresponding transition metal precursor being Fe $(CO)_5$ or Mo $(CO)_6$, respectively.

The source of transition metal precursors is preferably added to the liquid feed stream in an amount sufficient to provide at least a stoichiometric amount, or slightly more than the stoichiometric amount of transition metal, relative to the sulfur. Preferably, the transition metal is present in an amount of 1 to 50 wt %, more preferably, 10 to 20 wt % in excess over the stoichiometric amount of sulfur.

By the term "sonicating" is intended that the liquid feed stream containing the metal precursors is contacted with sonic vibrations (or energy). The sonic vibrations can be in the sonic frequency range, i.e. 1 Hz to 20 kHz, or the ultrasonic frequency range, i.e. above 20 kHz.

The reactor used to impart sonic vibrations to the hydrocarbon feed stream can utilize conventional means for producing the sonic vibrations. The feed stream can be pumped continuously through the reactor chamber at a rate sufficient to yield the desired residence time which may range from 1 second to several hours, depending upon the type of sulfur containing compounds and the sonicating conditions. Preferably, the residence time is from about 1 second to about 2 hours, more preferably about 10 minutes to about 2 hours, and most preferably about 20 minutes to about 60 minutes.

It is believed the sonic vibrations serve two functions. First, it is believed that the sonic vibrations mix the hydrocarbon feed, transition metal precursor(s) and any solvents that may be present, providing for intimate contact. Second, it is believed that the sonic vibrations cause molecular vibrations and cavitation with a resulting high pressure and/or high temperature at the molecular level due to the collapse of bubbles which breaks the metal bonds in the metal precursor, resulting in the formation of the metal particles as described herein.

The sonic vibrations are generally produced by sonic generators disposed in the liquid feed stream. Conventional electrosonic transducers may be employed to generate the sonic vibrations. The sonic vibrations can be generated using one or more transducers at a single frequency, a range of different selected frequencies or variable frequencies, i.e., chaotic frequencies.

The frequency (or frequencies) of the sonic vibrations can vary depending upon the composition of the feed stream and the specific transition metal precursor(s) used. It is believed that certain characteristic frequencies may be used to effectively reorient or degrade specific chemical bonds.

In one embodiment, one or more transducers can be used to provide sonic vibrations at characteristic frequencies corresponding to the resonance frequency of the metal bond in the precursor composition and/or particular carbon-sulfur bonds of the sulfur compounds present in the feed stream.

Sonic vibrations in the sonic reactor may be provided in a variety of ways, such as the use of "piezo-electro crystals" or the use a sonic transducer with a terfenol rod. The piezo-electro crystals are generally used to provide higher frequency, i.e., ultrasound vibrations, and to transmit a single frequency or a very narrow range of frequencies. A sonic transducer utilizing a terfenol rod can be used to provide a variable, i.e., selectable, frequency in a broader band range. Terfenol is an alloy composed of 90% iron (Fe), 5% dysprosium (Dy), and 5% terbium (Tb), which when excited by electricity drives a transducer to produce sonic vibrations or waves.

While the combination of the hydrocarbon feed stream, the transition metal precursor(s) and, optionally, solvents, may be contacted with sonic vibrations in a variety of ways, one method and apparatus for providing the sonic vibrations is shown in FIG. 1. FIG. 1 shows a continuous sonic reactor 1 which includes a sonic transducer 2 mounted within a sonic reactor vessel 3. The sonic transducer 2 includes a terfenol rod 4 enclosed within a transducer casing 5.

A power supply to the transducer 2 is supplied through a signal generator 6 and an amplifier 7 through two wires 8 which lead to and are coiled about the terfenol rod 4. The signal generator 6 provides a selectable frequency signal which when amplified by the amplifier 7 causes the terfenol rod 4 to vibrate with nearly identical frequencies as that produced by the signal generator 6. Generally, the signal generator 6 has a low power output, about 1 Watt or less, with the amplifier 7 increasing the power output to about 30 up to about 600 W. The sonic vibrations of the terfenol rod 4 are transmitted to a cone-shaped horn 9, which in turn vibrates at the same frequency as a terfenol rod 4. A distal end 10 of the horn 9 is located in close proximity to the inside surface of the sonic reactor vessel 3.

The continuous sonic reactor vessel 3 is generally a pipe-shaped vessel in which the sonic transducer 2 is located. The sonic transducer 2 is secured within the sonic reactor vessel 3 via centralizers 11 which serve to hold or stabilize the transducer 2 within the sonic reactor vessel 3.

In use, the hydrocarbon feed stream, containing the transition metal precursor(s)(and optional solvents) enters the sonic reactor vessel 3 from the left as shown in FIG. 1, and flows through an annular space 12 between the distal end 10 of the cone-shaped horn 9 and the inside surface of the sonic reactor vessel 3 and flows past the sonic transducer 2. As the hydrocarbon feed stream flows through this annular space 12, it is contacted by sonic vibrations emitted from the cone-shaped horn 9. As described below, the annular space 12, i.e., the distance between the distal end 10 of the horn 9 and the inside surface of the sonic reactor vessel 3, should be designed such that the majority of the hydrocarbon feed, transition metal precursors and optional solvents, passing through the annular space is contacted by sonic vibrations emitted from the horn 9. Generally the distance between the distal end 10 of the horn 9 and the inside surface of the sonic reactor is no larger than about 0.75 inches (19.1 mm), however, the distance will vary based upon the power input to the transducer and physical properties of the hydrocarbon feed stream.

The process of the present invention may use any sonic frequencies, i.e. any frequencies in the sonic (or audible range), i.e., 1 Hz to 20 kHz, or the ultrasonic range, i.e., above 20 kHz. The sonic frequency is preferably in the range of about 1 Hz to about 20 kHz, more preferably about 10 kHz to about 20 kHz, and most preferably about 20 kHz. It is preferable to use a fixed frequency or a narrow range of frequencies for a particular hydrocarbon feed stream. As these audible frequencies may be annoying or distracting to persons in the area, it is preferable to provide sound insulation.

As noted above, the design of the sonic reactor vessel 3, cone-shaped horn 9 and power input to the sonic transducer 2 should be designed together to ensure that the sonic waves emitted from the cone-shaped horn 9 propagate in a radial direction so as to contact essentially all the hydrocarbon feed stream passing through the annular space 12. In order to process a flow rate of about 4200 barrels per day, a sonic reactor having a 0.5 inch (12.7 mm) diameter terfenol rod mounted within a 1.5 inch (38.1 mm) casing 5, and located within a 3 inch (76.2 mm) ID sonic reactor vessel 3, with an annular space 12 of 0.75 inch (19.1 mm) and with a power input in the range of about 30 up to about 600 W, depending upon the physical characteristics of the hydrocarbon steam, should yield suitable results.

Generally, at lower frequencies, sonic vibrations or waves will propagate further through a fluid. Thus, the annular space 12 may be greater when lower frequencies are employed. Power input to the transducer 2/horn 9 may be increased by increasing wattage from the amplifier 7, providing a larger diameter terfenol rod 4, or by stacking rods. Also, the cone-shaped horn 9 may be extended in an axial direction to provide a greater residence time between the cone-shaped horn 9 and the inside surface of the sonic reactor vessel 3 such that the fluid flowing through the annular space 12 will be contacted by sonic waves for a longer time period. Further, several sonic reactors 1 could be provided in series to ensure that all of the hydrocarbon feed stream is contacted by the sonic vibrations.

It is also contemplated that the sonication reaction can be carried out in a batch mode. The batch sonic reactor can include one or more metal rods or transducers to produce the sonic energy. A transducer will typically include a tip having a diameter up to about 1 inch (25.4 mm).

For ultrasonic frequencies, ultrasonic horns which can generate ultrasonic vibrations may be situated through the reactor wall into the fluid. The ultrasonic horns can contain piezoelectric ceramics which vibrate at a given frequency when an electrical field is applied through attached electrodes. The vibrations are conducted through the horns into the reactor by metallic rods which also amplify the sound. The acoustic frequency for such electrodes may range from 10 to 50 kHz.

The energy input by the sonic generators generally increases the bulk temperature of the reacting fluid. Therefore, the reactor may also contain cooling coils to maintain the reaction temperature at the desired level. The sonic reactor typically operates at atmospheric pressure and at a temperature in the 10° C. to 150° C. range.

While not being bound by theory it is believed that the sonic vibrations (or energy) form transition metal particles, containing transition metal in a zero oxidation state, from the transition metal precursor compounds. With reference to the preferred transition metal carbonyl precursors, the reaction can be represented by the following:

$$M_n(CO)_x \leftrightharpoons nM^{(0)} + xCO \qquad \text{(II)}$$

wherein M is a transition metal selected from the metal values of Groups 6 and 8–12 (IUPAC Classification, previously Groups Vib, VIII, Ib and IIb) of the periodic table; x is an integer from 4 to 16; and n is an integer from 1 to 6; in which x and n correspond to a stable transition metal carbonyl compound at room temperature.

The transition metal carbonyl is stable at room temperature and 1 atm. However, the reaction of equation II reverses at higher temperatures or lower pressures. As discussed above, it is believed that the sonic vibrations result in high temperatures at the molecular level, sufficient to reverse the reaction, forming transition metal in a zero oxidation state and evolving carbon monoxide.

The transition metal forms as metal particles with diameters in the nanometer range, preferably less than about 200 nm and, more preferably less than about 100 nm, and having a high surface area. It is believed that the metal particles are highly reactive and instantly react with the sulfur in the sulfur-containing compounds in the hydrocarbon liquid feed stream. The reaction can be represented by the following:

$$M^{(0)}+xC_nH_mS+xH_2 \rightarrow xC_nH_{m+2}+MS_x \quad \text{(III)}$$

wherein M is a transition metal selected from the metal values of Groups 6 and 8–12 (IUPAC Classification, previously Groups Vib, VIII, Ib and IIb) of the periodic table; x is an integer from 4 to 16, corresponding to a stable metal-sulfur compound; n and m are integers greater than or equal to 4, which correspond stoichiometrically for sulfur containing compounds normally found in hydrocarbon stocks, e.g., crude oil.

The transition metal reacts with the sulfur-containing compound in the presence of a source of hydrogen to yield a hydrocarbon compound which is free of sulfur and a metal-sulfur compound. For example, $Mo(CO)_6$ can be reacted with thiophene in the presence of $H_2$ and sonic vibrations to yield butadiene and $MoS_2$.

The source of hydrogen can be hydrogen gas added to the reaction mixture. The source of hydrogen can also be water that can react with the released CO from the metal carbonyl decomposition reaction (equation II above) to produce $H_2$. This water-gas-shift (WGS) reaction can be represented as follows:

$$CO+H_2O \leftrightarrows H_2+CO_2 \quad \text{(IV)}$$

Alternatively, $H_2$ can be produced via abstraction from a solvent.

The amount of hydrogen present is preferably approximately a stoichiometric amount relative to the sulfur-contain compounds contained in the feed stream in accordance with Equation III. The amount of hydrogen should be limited to avoid unwanted hydrocracking reactions.

The reaction conditions for the sulfur removal method according to the invention is preferably controlled to maximize sulfur removal and to minimize compositional changes to the hydrocarbon stream, i.e., minimize changes which adversely affect motor fuel performance, such as reducing the octane number.

The preferred sonication conditions can include a temperature in the range of about 10 to about 150° C., more preferably about 20 to about 140° C., and most preferably about 50 to about 100° C. The sonication residence time is preferably in the range of about 1 second to about 2 hours, more preferably 10 minutes to about 2 hours, and most preferably 20 minutes to about 60 minutes.

The separating step can be accomplished through at least one of settling out, decanting, filtration or centrifugal separation.

In a preferred embodiment, the present invention is directed to a method for reducing the sulfur content of a sulfur-containing hydrocarbon liquid feed stream under mild conditions, in which the method includes:

adding a transition metal carbonyl precursor to the liquid feed stream;

sonicating the liquid feed stream containing the transition metal carbonyl precursor at a temperature in the range of about 10° C. to about 150° C. for a time sufficient to produce solid metal sulfide particles and a liquid product having a reduced sulfur content; and separating the solid metal sulfide particles from the product.

The solid metal sulfide particles can be reacted with CO to produce elemental sulfur and the transition metal carbonyl precursor, which can be recycled to the sulfur removal process. Including such a step to the process of the invention will make the overall sulfur removal process truly catalytic.

EXAMPLES

The following non-limiting examples have been carried out to illustrate the preferred embodiments of the invention at the present time. The examples include methods for reducing the sulfur content of sulfur-containing hydrocarbon feeds according to the invention.

Example 1

The sulfur content of thiophene was reduced in accordance with the present invention as follows: 20 millimoles of white $Mo(CO)_6$ was slurried in 100 mL of hexadecane and 50 millimoles of thiophene was added to the slurry. A model XL 2020 ultrasonic liquid processor, from MISONIX, Inc., with a variable power output of up to 550 watts at a fixed frequency of 20 kHz was used. The unit was fitted with a 5-inch long half-wave extender tip with a probe tip of diameter 0.125 to 0.5 inches. The unit allowed precise control of power output, processing time and PULSAR cycle for cyclic intermittent operation to avoid heat build-up. The sonication settings for the run was as follows: Intensity=100% and pulsed cycle=80%. The slurry was purged with $N_2$ and then sonicated at a temperature of 34° C. The temperature was maintained within ±1° C. during the run. Within minutes, the white slurry started to turn black. The sonication was continued for 1.5 hours. The black slurry was then transferred to glass tubes and centrifuged. After decanting, the black solid was washed with n-hexane and then centrifuged. The wash/centrifuge cycle was repeated three times. The black solid was dried in vacuo and stored in a glove box.

The black solid was identified as $MoS_2$ by Energy Dispersive (EDS) analysis. Since thiophene was the only source of S in the slurry, the formation of $MoS_2$ confirmed that the Mo metal particles formed during sonication of the Mo $(CO)_6$ reacted with the sulfur in the thiophene.

Example 2

A method according to the invention was used to reduce the sulfur content of a sample of MWS (Midway Sunset) crude oil. The MWS crude oil had the following composition: C=86.5%, H=11.0%, N=0.8%, S=1.10%, API=13. Of the S present, it was a mixture of only organic S-containing compounds of the type listed in Table 1.

A solution was prepared by combining 25 mL of the MWS crude oil with 70 mL of hexadecane and 10 millimoles of Fe $(CO)_5$. The solution was sonicated, as described in Example 1, but at a temperature of 39° C. for 320 minutes. The sonicated solution yielded a product oil having a reduced sulfur content and a black solid material.

Figure 2:
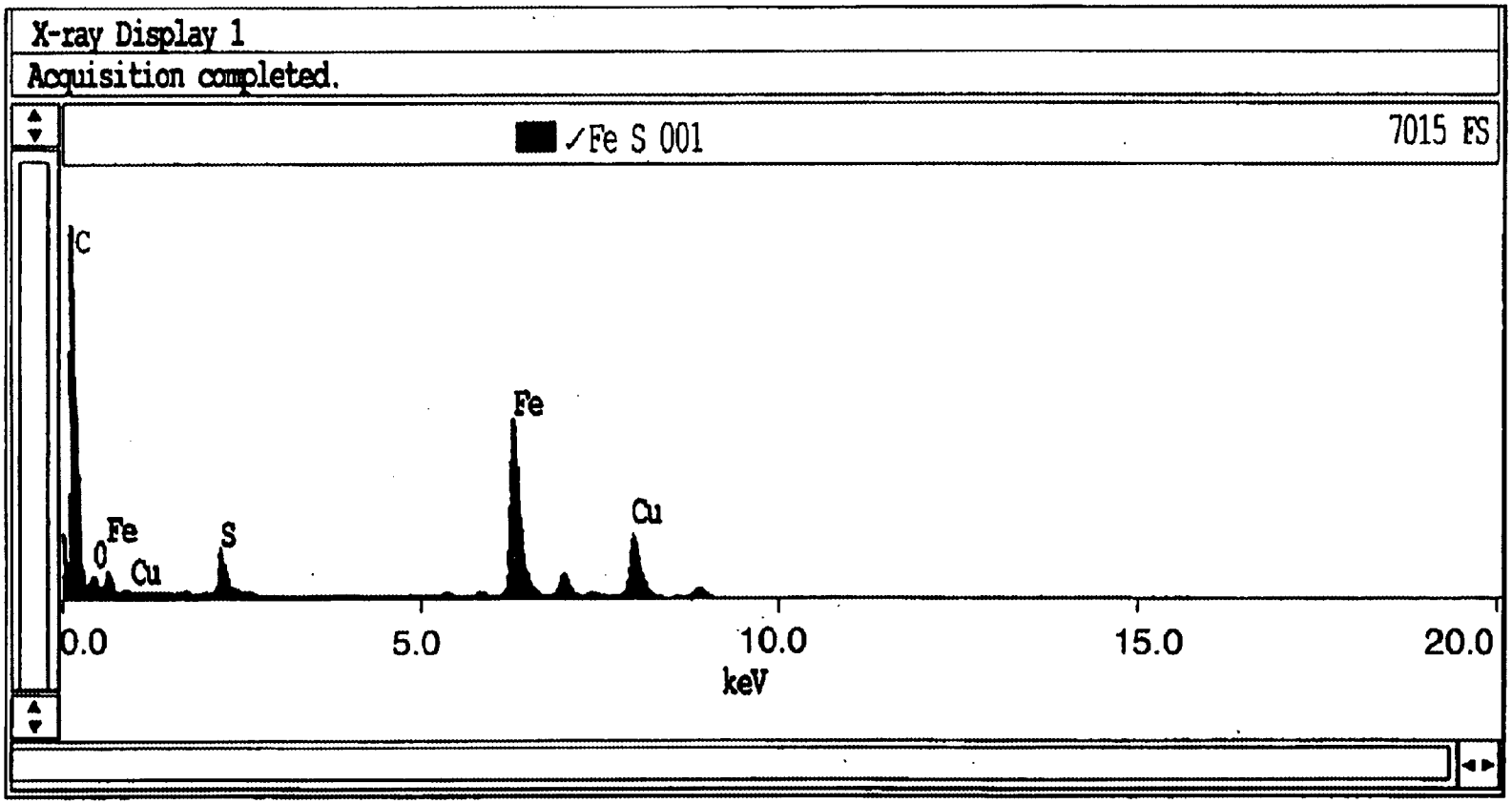
FIG. 2 is an energy dispersive analysis (EDS) pattern described in Example 2.
Figure 3:
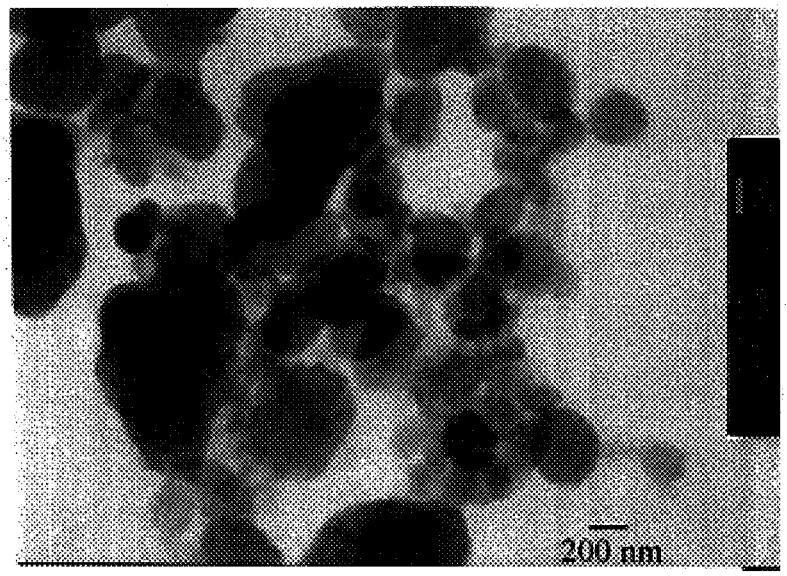
FIG. 3 is a transmission electron micrograph described in Example 2.

The black solid material was separated from the product oil, washed three times with n-hexane and dried in vacvo to yield 1.6 grams of $FeS_2$. The EDS analysis confirmed the presence of Fe and S in the black solid. The EDS pattern is shown in FIG. 2. A transmission electron micrograph (TEM) of the black solid $FeS_2$ is shown in FIG. 3.

Since the aromatic sulfur containing compounds contained in the MWS crude oil was the only source of sulfur in the solution, the formation of $FeS_2$ confirmed that the sulfur from the compounds reacted with the Fe particles formed by sonolysis of the $Fe(CO)_5$.

Example 3

Example 1 was repeated using a sulfur-containing diesel sample. The sulfur content of the diesel was 425 ppm. 15 millimoles of $Fe(CO)_5$ was mixed with 70 mL diesel and the resulting yellow solution was subjected to sonication as described in Example 1. After one hour, a slurry containing a product diesel oil having a reduced sulfur content and a black solid material was obtained. The black solid was separated from the product diesel oil by centrifuging. A sample of the treated product diesel oil was analyzed on a GC/Mass Spectrometer (GC/MS). The data confirmed that sulfur was removed from even the severely hindered benzothiophenes during sonication.

Example 4

Example 3 was repeated with a lower $Fe(CO)_5$/Diesel ratio. For this run, 2 millimoles $Fe(CO)_5$ per 100 mL diesel were added. After one-hour of sonication, a black slurry was produced. The slurry was centrifuged to separate a black solid material from the treated diesel. The GC/MS analysis of a sample of the treated diesel revealed that the treated diesel was lower in organic sulfur species, including the severely hindered ones.

Example 5

The sulfur content of dibenzothiophene was reduced in accordance with the present invention as follows: 0.4 millimole of dibenzothiophene was dissolved in 100 mL hexadecane to produce 0.1 wt % (1000 ppm) solution. 2 millimoles $Fe(CO)_5$ was added to achieve a 5/1 ratio of the $Fe(CO)_5$/dibenzothiophene. The solution was sonicated at 44° C. for 10 minutes by the procedure described in Example 1. A non-pyrophoric black solid was separated and characterized. The data confirmed that sulfur was removed from the dibenzothiophene.

Thus, while there has been disclosed what is presently believed to be preferred embodiments of the invention, those skilled in the art will appreciate that other and further changes and modifications can be made without departing from the scope or sprit of the invention, and it is intended that all such other changes and modifications are included in and are within the scope of the invention as described in the appended claims.

What is claimed is:

1. A method for reducing the sulfur content of a sulfur-containing hydrocarbon liquid feed stream comprising:

contacting said hydrocarbon feed stream with transition metal particles, containing transition metal in a zero oxidation state and having an average diameter of less than about 200 nm;

sonicating said liquid feed stream/transition metal particle combination under reaction conditions sufficient to provide a product having a reduced sulfur content and metal sulfide particles; and separating said metal sulfide particles from said product.

2. A method according to claim 1, wherein said transition metal particles are provided by:

adding a transition metal carbonyl precursors to said liquid feed stream prior to the sonicating step, wherein the sonicating step is performed under conditions sufficient to produce said transition metal particles.

3. A method according to claim 2, wherein said transition metal carbonyl precursor is of the formula:

$$M_n(CO)_x$$

wherein M is a transition metal selected from an element of Groups 6 and 8–12 of the periodic table, n is an integer from 1 to 6 and x is an integer from 4–16.

4. A method according to claim 3, wherein said transition metal is selected from Fe or Mo.

5. A method according to claim 2, wherein said transition metal carbonyl precursors is added to said liquid feed stream in an amount sufficient to provide at least a 1:1 molar ratio of metal:sulfur.

6. A method according to claim 2, wherein said sonication conditions include contacting said feed stream with sonic vibrations having a frequency in the range of about 1 Hz to about 20 kHz, at a temperature in the range of about 10 to about 150° C. and a sonicating residence time in the range of about 1 second to about 2 hours.

7. A method according to claim 1, wherein the separating step is accomplished through at least one of setting out, decanting, filtration and centrifugal separation.

8. A method for reducing the sulfur content of a sulfur-containing hydrocarbon liquid feed stream under mild conditions, said method comprising:

adding a transition metal carbonyl precursor to said liquid feed stream;

sonicating said liquid feed stream containing said transition metal carbonyl precursor at a temperature in the range of about 10° C. to about 150° C. for a time sufficient to produce solid metal sulfide particles and a liquid product having a reduced sulfur content; and separating said solid metal sulfide particles from said product.

9. A method according to claim 8, wherein said transition metal carbonyl precursor is selected from the group consisting of Fe $(CO)_5$ and Mo $(CO)_6$.

10. A method according to claim 8, further comprising adding a solvent to said liquid feed stream, prior to the sonicating step.

* * * * *